US007621564B2

(12) United States Patent
Lenhart

(10) Patent No.: US 7,621,564 B2
(45) Date of Patent: Nov. 24, 2009

(54) POLE GRIP

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 155 days.

(21) Appl. No.: 11/794,344

(22) PCT Filed: Feb. 6, 2006

(86) PCT No.: PCT/CH2006/000069

§ 371 (c)(1),
(2), (4) Date: Jun. 28, 2007

(87) PCT Pub. No.: WO2006/084403

PCT Pub. Date: Aug. 17, 2006

(65) Prior Publication Data

US 2008/0036191 A1 Feb. 14, 2008

(30) Foreign Application Priority Data

Feb. 8, 2005 (CH) ..... 0199/05

(51) Int. Cl.
*A63C 11/00* (2006.01)

(52) U.S. Cl. ..... 280/821; 280/819

(58) Field of Classification Search ..... 280/822, 280/821, 816, 824, 819, 823, 825, 813, 809; 16/436, 421, 422; 135/72, 76
See application file for complete search history.

(56) References Cited

U.S. PATENT DOCUMENTS 3,085,814 A * 4/1963 Scott ..... 280/821
3,113,786 A * 12/1963 Phillipson ..... 280/822
3,335,585 A * 8/1967 Stratton ..... 280/814
3,560,014 A * 2/1971 Bruckl et al. ..... 280/821
3,561,782 A * 2/1971 Tyrack ..... 280/816

(Continued)

FOREIGN PATENT DOCUMENTS

DE 681 01 226.8 U1 4/1981

(Continued)

*Primary Examiner*—Hau V Phan
(74) *Attorney, Agent, or Firm*—Sughrue Mion, PLLC

(57) ABSTRACT

The invention relates to a stick/pole grip (1), particularly for walking sticks, trekking poles, alpine ski poles, cross-country ski poles and Nordic walking poles, with a grip body (3) and with a device (11-14) for adjustably fastening a hand-retaining device, particularly provided in the form of a hand strap (2) or a glove. The inventive stick/pole grip is characterized in that the hand-retaining device has, at least in a fastening area, a fastening means provided in the form of a strip, a strap, a belt or a rope for fastening to the stick/pole grip (1), and that the device has an eccentric element (11) that can rotate and/or pivot about an axis (12), this eccentric element (11) having a surface in the fastening area whose radius (a, b, c) increases toward the axis (12) in a fixing direction of rotation (F) at least in a step-by-step, continuously, ribbed or stepped manner so that the fastening means guided in the fastening area between this surface of the eccentric element (11) and a fixed abutment (14) is clamped between the eccentric element (11) and the abutment (14) by rotating or pivoting the eccentric element (11) in the fixing direction of rotation (F). This design makes possible an extremely simple and reliable variable fastening of a hand-retaining device on the stick/pole grip.

12 Claims, 2 Drawing Sheets

U.S. PATENT DOCUMENTS

| | | | | | |
|---|---|---|---|---|---|
| 3,810,647 | A * | 5/1974 | Martchenke | 280/816 |
| 4,288,100 | A * | 9/1981 | Aho | 280/821 |
| 4,288,101 | A * | 9/1981 | Aho | 280/821 |
| 4,645,235 | A * | 2/1987 | Joseph | 280/821 |
| 6,139,060 | A * | 10/2000 | Lenhart | 280/821 |
| 6,264,242 | B1 * | 7/2001 | Lenhart | 280/822 |
| 6,311,370 | B1 * | 11/2001 | Blin | 16/436 |
| 6,325,418 | B1 * | 12/2001 | Lenhart | 280/821 |
| 6,439,610 | B1 * | 8/2002 | Pronzati | 280/822 |
| 6,644,328 | B1 * | 11/2003 | Lenhart | 280/819 |
| 6,851,437 | B1 * | 2/2005 | Lenhart | 135/72 |
| 7,226,084 | B2 * | 6/2007 | Lenhart | 280/822 |

FOREIGN PATENT DOCUMENTS

| | | | |
|---|---|---|---|
| DE | 196 32 718 | A1 | 7/1997 |
| DE | 299 06 612 | U1 | 9/2000 |
| DE | 201 14 396 | U1 | 2/2003 |
| EP | 0 919 147 | A2 | 6/1999 |
| EP | 1 053 770 | A1 | 11/2000 |
| EP | 1 118 362 | A2 | 7/2001 |
| FR | 2 573 318 | A1 | 5/1986 |

* cited by examiner

POLE GRIP

TECHNICAL FIELD

The present invention relates to a pole grip, in particular for walking sticks, trekking poles, downhill ski poles, cross-country ski poles and Nordic walking poles, having a grip body and having a device for the adjustable fastening of a hand-retaining device in particular in the form of a hand strap or of a glove.

PRIOR ART

Such a device may be configured, for example, such that a hand strap is fastened on the pole grip via a screw or via a wedge, and the screw or the wedge provides a straightforward option for adapting the length of the hand strap, as far as possible without using any tools, to the user's requirements. Such mechanical devices should be as reliable as possible, and should not allow any undesirable adjustment of the length of the strap during use. In addition, it should allow adjustment without any complicated manipulation and, in order to keep costs low, it should be of extremely straightforward design. On the other hand, such fastening mechanisms, and this is very important in particular in downhill skiing, should be capable of performing this releasable arresting function over the widest possible temperature range.

Such a design is known, for example, from German Utility Model DE 681 01 226 U1. In the latter document, a strap is fastened in an adjustable manner on the pole by the strap band being guided around two pins in the fastening region of the pole. Adjustment is carried out via a tiltable element which is arranged on the head of the pole grip and in which these two pins are arranged. If this tilting element is swung upward out of a recess in the pole grip, then the length of the hand strap can be adjusted. If the tilting element is swung at least partially downward again into the pole grip, then the length of the hand strap is fixed.

There are also solutions in which, with the aid of a slotted region of the strap band, adjustability is achieved when the hand strap is moved upward whereas, when the hand strap is directed downward, the length of the hand strap is fixed. Such options are described, for example, in DE 19632718, DE 29906612 U1, and similarly EP 1118362.

The problem with these known solutions, inter alia, is the fact that, although straightforward adjustment is provided, secure fixing is very difficult if not impossible. In other words, these known solutions often have the disadvantage that during use, for example if the hand strap is accidentally pulled upward, they allow the length of the hand strap to be adjusted at an undesirable point in time.

DESCRIPTION OF THE INVENTION

This is where the invention comes in. The object of the invention is thus to provide an alternative pole grip to those in the prior art. The concern here in particular is to improve a pole grip for walking sticks, trekking poles, downhill ski poles, cross-country ski poles and Nordic walking poles, this pole grip having a grip body and a device for the adjustable fastening of a hand-retaining device in particular in the form of a hand strap or of a glove.

This object is achieved in that, for fastening on the pole grip, the hand-retaining device has, at least in a fastening region, a fastening element in the form of a band, of a belt or of a woven-fabric strand, and in that the device has an eccentric element which can be rotated and/or pivoted about an axial member, which eccentric element, in the fastening region, has a surface of which the radius, in relation to the axial member, increases in the arresting direction of rotation, in which case, by virtue of the eccentric element being rotated or pivoted in the arresting direction of rotation, the fastening element guided, in the fastening region, between this surface of the eccentric element and a stationary abutment is clamped between the eccentric element and abutment. The radius of the surface of the eccentric element here can increase continuously and, as it were, smoothly; however, it may also increase at least in sections, or in ribbed or stepped fashion.

An essential part of the invention is thus the use of an eccentric element for fixing the fastening element. This extremely straightforward design element proves to be surprisingly efficient for the releasable fixing of a fastening element in the form of a band, or of a belt or of a woven-fabric strand, since, on the one hand, it can be released without an excessive amount of force being applied in order adjust the length of the hand-retaining device on the pole grip, and since, on the other hand, it preferably makes it possible for the length of the hand-retaining device actually to be fixed, essentially irrespective of the position of the hand-retaining device. An eccentric element can be integrated to good effect in the pole grip and is very reliable, and the orientation of the eccentric element may preferably be selected such that, when the hand-retaining device is subjected to pulling, the eccentric element is pulled into its fixed position, that is to say, when the hand-retaining device is subjected to pulling, the fastening mechanism is fastened to an even more pronounced extent. As an alternative, however, it is also possible, in the manner of a safety-activation means, for the eccentric element to be arranged precisely the other way around, in which case, if the hand-retaining device is subjected to accidental pulling, for example in the event of a fall, it is possible for the hand strap, for example, to be released.

A first preferred embodiment of the invention is characterized in that the axial member of the eccentric element is arranged essentially perpendicularly to the pulling direction of the fastening element and in particular preferably essentially perpendicularly to the pole axis. If the eccentric element is arranged in this way, then the forces occurring on the hand-retaining device can be optimally absorbed by the eccentric element, and it is possible, at the same time, to release the eccentric element without any great amount of force being applied, in order to alter the distance between the hand-retaining device and the pole grip.

The eccentric element can be basically of any form where its radius, in relation to the axial member, increases in the arresting direction of rotation at least in sections. It is thus possible to use, for example, an eccentrically mounted ball or an eccentrically mounted cylinder, or also crosses between these two types of element or the like. Use of an eccentrically mounted cylinder is preferred in particular since this makes it possible to achieve optimum interaction with a strip-like or band-like hand-retaining device, located in the fastening region, against an abutment over the width of the cylinder.

According to a further preferred embodiment, the eccentric element has a lever or swing-action handle which can be manipulated from the outside and by means of which the eccentric element can be rotated or pivoted in order to clamp the hand-retaining device. As an alternative, however, it is also possible to provide, for example on the eccentric element, a ribbing arrangement or even (step-up) transmission means, which are accessible from the outside of the pole grip. It is typically possible here for the swing-action handle, for the purpose of releasing the fastening of the hand-retaining device to be swung upward and, for the purpose of clamping the fastening of the hand-retaining device, to be swung over forward or rearward in which case the lever is arranged essentially horizontally in the arresting position. The swing-action handle is thus least obtrusive in the fixed position on the pole grip and is barely noticeable during use of the pole. This can be achieved, in particular, by the lever or the swing-action handle being arranged on the top side of the pole grip, and preferably in the arresting position being integrated at least partially, or in particular more or less entirely, within the outer contour of the grip body. At least the tip should be exposed, in order to be freely accessible for release purposes (this, for example, also being the case with gloves).

A further preferred embodiment is distinguished by particularly practical integration in the pole grip, namely by, from the hand side, the grip body having, at the top end, a recess which, in the direction of the top side of the pole grip, has a through-opening in which the eccentric element is mounted in particular preferably by way of an axial pin guided in the grip body on both sides. The eccentric element rather than being arranged entirely in this opening, preferably projects into the recess. It is also possible to arrange the eccentric element in the recess and to allow only the swing-action handle to pass through the opening. The abutment is preferably formed in the recess in the manner of a crosspiece or pin which is arranged beneath the eccentric element, is supported in the grip body on both sides and is arranged in particular preferably parallel to the axial member of the eccentric element. It is also possible for two or even more such abutments to be present. The entire arresting device is thus integrated more or less completely within the pole grip as long as the swing-action lever is in its arresting position, that is to say essentially horizontal. It is also possible to arrange the swing-action lever on the front edge, in which case it is also conceivable for a swung-in position to be vertical.

The recess has, for example, a height in the range of 12-15 mm, and a width of 10-15 mm, but may also be configured to be smaller, for example in the case of cross-country ski poles or Nordic walking poles, which in some cases are of somewhat narrower design.

As has already been mentioned above, the hand-retaining device, for the purpose of clamping between the eccentric element and the abutment, has at least one portion (fastening element) in the form of a band, of a belt or of a woven-fabric strand. This portion is preferably flexible. It may be, for example, a plastic strip, although it is preferably a flexible portion of a band or belt, and, in the case of a hand strap, this entire strap can also form the hand-retaining device. Use is preferably made of materials for hand straps such as, for example, woven-fabric bands, preferably made of plastic. This portion, starting from the hand-retaining device, is initially guided through between the eccentric element and abutment, is then guided downward around the abutment and is subsequently guided out of the recess. A free end remains and it is possible for the length at which the hand-retaining device is attached to the pole grip to be adjusted via this free end. The free end can pass out of the pole grip either in the downward direction or else in the upward direction.

Corresponding to a further preferred embodiment, the hand-retaining device is a strap with its top end fastened in a fixed or releasable fashion, in the manner of a safety-activation means, on the grip body, in particular preferably on the base of the recess. This strap is guided around the hand and has a region guided into the recess of the pole grip, in which case the free end projects out of the pole grip in the downward direction. Analogously, it is, of course, possible to fasten the fastened end of the hand strap at the bottom of the recess and to guide it in an equivalent manner from bottom to top through the fastening device, in which case the free end projects out of the recess of the pole grip in the upward direction. It is also possible, if the strap is fastened on the top side to fasten the fastened end of the hand strap on the swing-action lever, for example, from beneath. Movement of the strap in the upward direction, in this case, can release the eccentric element and thus render the strap adjustable. Equally, the eccentric element can be fixed by moving the top portion of the hand strap.

As already mentioned, the hand-retaining device may be a hand strap or else a glove or a strap-like device which can be fastened on the hand, the latter two options having, essentially between the thumb and forefinger, at least one band which is guided into the recess of the pole grip and via which, correspondingly, the hand-retaining device can be fixed in an adjustable manner on the pole grip.

Further preferred embodiments are described in the dependent claims.

BRIEF EXPLANATION OF THE FIGURES

The invention will be explained in more detail below with reference to exemplary embodiments, in conjunction with the drawings, in which.

WAYS OF IMPLEMENTING THE INVENTION

The exemplary embodiments illustrated in the figures should serve to illustrate, and support, the idea of the invention, but should not be used to limit the scope of the idea of the invention as formulated in the claims.

Figure 1:
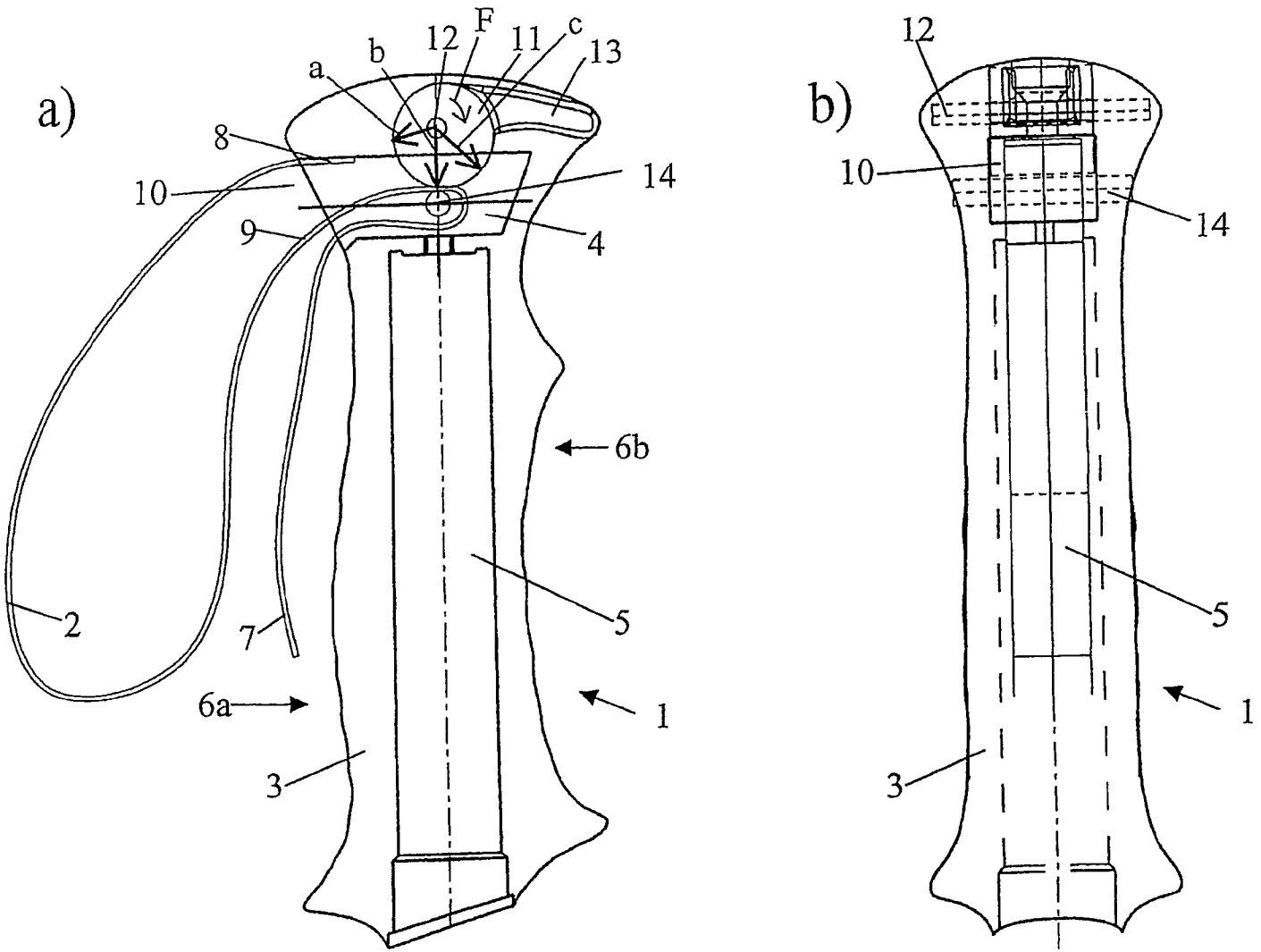
FIG. 1 shows sections through a pole grip with an eccentric element, a) illustrating a central section, and b) likewise illustrating a central section, this time taken perpendicularly to the section according to FIG. 1*a*)

FIGS. 1*a*) and *b*) illustrate different sections of a first exemplary embodiment of a pole grip according to the invention. The pole grip 1 comprises a grip body 3, which is usually produced from a plastic material by injection molding. As seen from beneath, the grip body 3 has a recess or a cavity 5 into which the pole, which is formed, for example, from an aluminum shaft, can be pushed and fastened.

At its top end, the pole grip 1 has a recess 4 which is designed from the hand side 6*a* in the first instance, as it were, as a blind hole. The hand strap 2 is fastened in this recess 4, which typically has a height in the range of 12-15 mm, and a width of 10-15 mm. For fastening purposes, the recess, in the direction of the top side of the pole grip has an opening in which an eccentric element 11 is mounted. This is essentially a plastic cylinder (a cylinder made of metal is also conceivable) which is mounted eccentrically, that is to say, rather than being mounted along its center-of-gravity axis, it is mounted in an offset manner in relation to the same. In the case of the exemplary embodiment according to FIG. 1*a*, the axial member 12 is displaced somewhat upward and to the left in relation to the center-of-gravity axis, since the eccentric element is intended, via rotation in the clockwise direction, to fix a band located beneath it. The eccentric element 11 has a swing-action handle 13, which is either formed integrally with the eccentric element 11 or fastened on the same. The swing-action handle is oriented in the direction of the front side 6*b* of the grip. When it is located in the fixing position, as is illustrated in FIG. 1*a*), the swing-action handle 13 is at least partially recessed in a groove which is made in the pole grip 3 from above. The eccentric mounting of the eccentric element 11 gives rise, in relation to the axial member 12, to radii which differ depending on rotary position. These different radii are depicted by the arrows a (short radius), b (radius in typical fixing position) and c (large radius).

The axial member 12 is mounted in the pole grip 3, as can be seen in particular in FIG. 1*b*). The lateral surface of the cylinder of the eccentric elements may have an essentially unmodified surface; it is also possible however, in particular in the downwardly directed region, where the fixing action is to be effected, to provide a special surface for increasing the friction in relation to the hand strap, for example a roughened surface or one with ribs transverse to the loading direction, or the like.

Directly beneath the eccentric element 11, a pin 14 is arranged coaxially in relation to the axial member 12. This pin 14 forms the abutment or the surface on which the strap is fixed. It is also the case that the pin 14, as can be seen in FIG. 1*b*), is incorporated in corresponding recesses or bores in the grip body 3. The pin 14 may also be provided with a special surface structure in order to increase the friction between the pin 14 and the strap. Here too, in other words, it is possible to have a roughened surface or ribs parallel to the axis of the pin 14 or the like.

In this exemplary embodiment, a hand strap 2 has its fastened end 8 screwed or riveted to the top wall of the recess 4. The hand strap is guided around the hand, and the other end is then guided, in the region 9, into the recess 4 and is guided between the pin 14 and the eccentric element 11. Subsequently, the strap is guided downwardly around the pin 14 and guided out of the recess 4 again. A free end 7 of the hand strap forms as a result.

It should be pointed out, in this context, that it is not absolutely necessary for the free end to be guided out of the pole grip 3 in the direction of the hand side 6*a* again. It is likewise readily possible for the free end 7 to be guided out of the pole grip in the forward direction, through a hole provided for this purpose, toward the front side 6*b*. It is also possible to allow the free end 7 to pass out of the pole grip 1 in the upward direction or even to guide the free end downward through the grip body 3, in which case it only passes out of the pole grip at the bottom, for example at the bottom edge, and therefore does not get in the way at all here.

In the case of each of these embodiments, when the fastening device is released, the strap 2 can be shortened by virtue of the free end 7 being subjected to pulling.

It is also possible to configure the fastening on the pole grip in the region 8 as a safety-activation means. In other words, the fastening may be configured such that, in the case of a force above a defined level, it releases the strap at its fastening. This can be achieved in a variety of different ways, for example by the strap being attached, in its region 8, in the first instance to a plastic element which is fitted into a corresponding recess in the pole grip and can be released from this recess via material deformation in the event of pronounced pulling. The activation force here may even be defined, in some cases, via the material of the plastic element. However, more complex mechanisms, which may be adjustable via springs or the like, are also possible.

The actual fastening takes place, as already explained, by the clamping between the eccentric element 11 and pin 12. FIG. 1*a*) illustrates the clamped state, that is to say the state in which the length of the strap cannot be changed. In this state, the swing-action handle 13 is recessed, in the forward direction, essentially within the pole grip.

If the hand strap 2 is then adjusted, the swing-action handle 13 is gripped at the front, from beneath, and pulled upward and/or rotated in the counterclockwise direction. In this case, the eccentric element 11 rotates about the axial member 12. Whereas, in the fixing position, the large radius b was oriented in the direction of the pin 14, this rotation then causes the radius to become gradually shorter, as a result of the eccentricity, until, for example, the position illustrated by the arrow a is reached. In this position, the swing-action handle 13 is oriented almost entirely in the upward direction, and the interspace between the eccentric element 11 and the pin 14, then, has been widened such that the band located therebetweeen is released to the full extent and either the hand strap 2 can be shortened, by being pulled at the free end 7, or lengthened, by being pulled at the region 9.

Once the length of the strap has been changed, the strap can be fixed in the new position by virtue of the swing-action handle 13 being swung down in the clockwise direction (arresting direction of rotation F). Since the radius gradually increases during rotation, the clamping between the eccentric element 11 and the abutment 14 is defined, as desired, in accordance with the force on the swing-action handle 13.

Using the eccentric element 11 thus has, inter alia, the advantage that the arresting force can be defined in adaptation to requirements. Moreover, tolerances in the range of the thickness of the band guided between the eccentric element and abutment 14 do not have any great effect, as is the case with other fastening mechanisms. Such tolerances can readily be absorbed, and if, for example, a band region which is somewhat thicker is pushed between 11 and 14, then the lever 13 has to be swung down to a somewhat lesser extent in the clockwise direction F, and if for example, a band region of the strap which is somewhat thinner is pushed therebetween, then the lever 13 is simply swung down somewhat further in the clockwise direction. In order for the latter to be possible, rather than a stop being provided for the swing-action handle 13, preferably on the pole grip the groove in the grip body 3 is provided with sufficient clearance for movement to allow the swing-action handle 13 to be used for arresting purposes even in the case of a thin band or in the case of the eccentric element 11 being worn.

This gives the advantage, on the one hand, that relatively large tolerances are possible in respect of the thickness of the strap material and, on the other hand, that even regions which may already be partially damaged, or have been subjected to pronounced compression as a result of intensive use, can readily be fastened. The latter in particular often poses problems in the case of the conventional fastening mechanisms.

Moreover, the wear caused by the fastening mechanism is kept to a minimum as a result of the surface pressure of the strap material between the pin 14 and the cylinder surface of the eccentric element 11.

Figure 2:
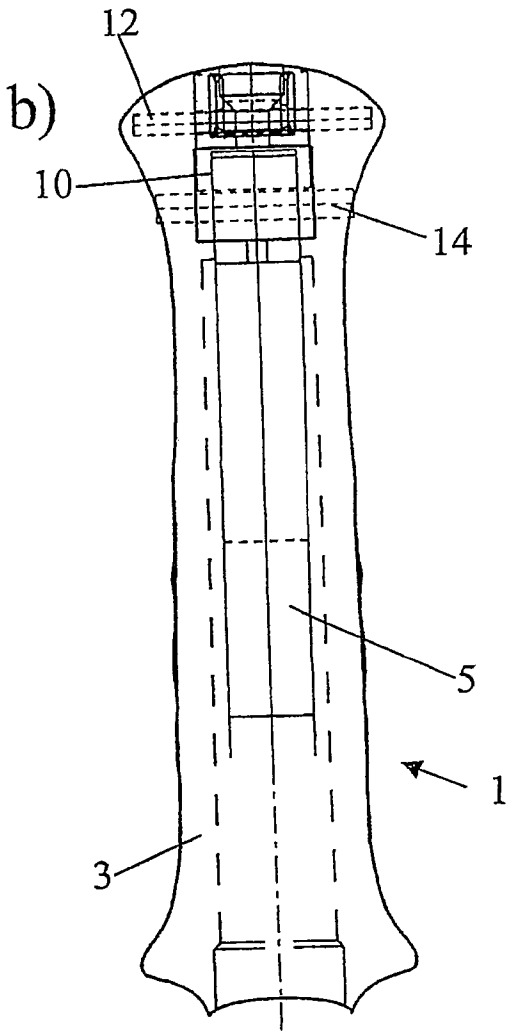
FIG. 2 shows sections through an alternative pole grip with an eccentric element, a) illustrating a central section, and b) likewise illustrating a central section, this time taken perpendicularly to the section according to FIG. 2*a*).
Figure 2:
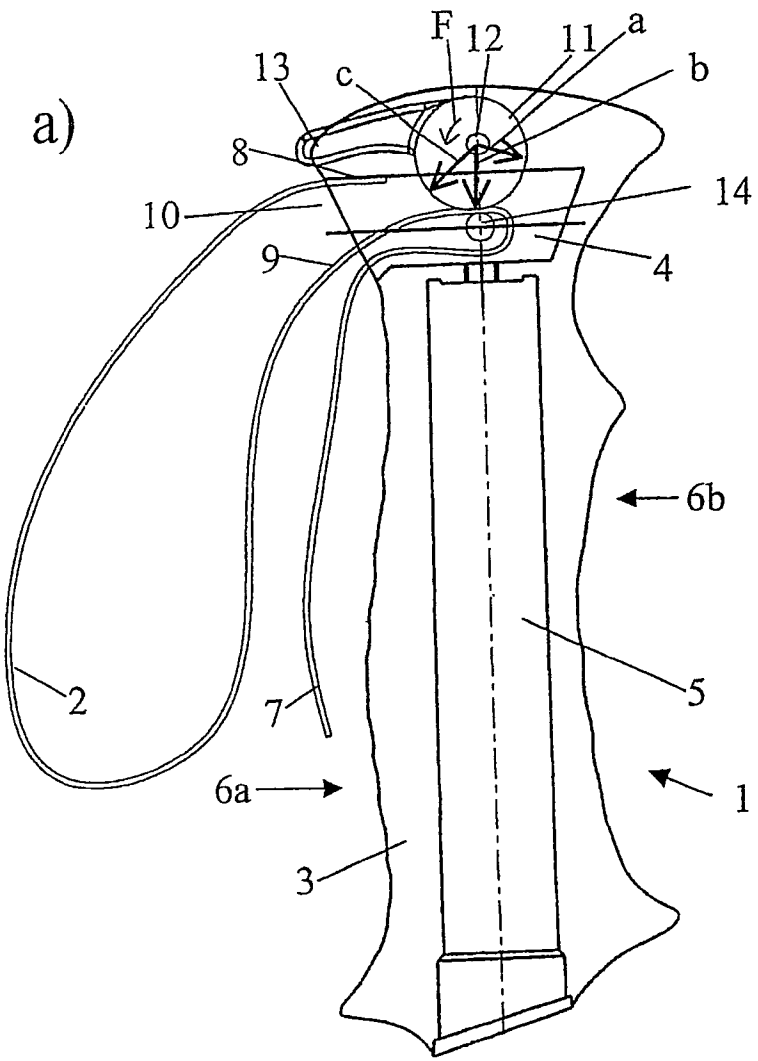

FIG. 2 shows an analogous exemplary embodiment, although in this case, rather than being arrested in the clockwise direction, the swing-action handle 13 is arrested in the counterclockwise direction (arresting direction of rotation F). Whereas, in the exemplary embodiment according to FIG. 1, the eccentric element 11 is fixed yet further under the loading caused by the hand strap being subjected to an exceptional pulling force, this is not the case in the exemplary embodiment according to FIG. 2. On the contrary, it is even possible here, in some cases, for the strap band to be released when subjected to pronounced loading since pulling at the region 9 results in a torque counter to the arresting direction of rotation F, and can thus rotate the swing-action handle upward. This may be expedient, for example, as a safety-activation means.

In the case of an exemplary embodiment according to FIG. 2, it is also possible for the end 8 of the strap, rather than being fastened on the grip body 3, to be fastened on the top side, or preferably the underside, of the swing-action handle 13 or to be fixed in a slot in the swing-action handle. This makes it possible to release the eccentric as a result of the strap 2 being pulled upward, either as a safety function or, quite simply, in order to release the fixing for the purpose of adjusting the length of the hand strap.

LIST OF DESIGNATIONS

1 pole grip
2 hand strap
3 grip body
4 recess in 3
5 cavity in 3 for pole shaft
6*a* hand side of the grip
6*b* front side of the grip
7 free end of the hand strap
8 fastened end of the hand strap
9 hand-strap region guided into the pole grip
10 opening of 4
11 eccentric cylinder
12 axial member of 11
13 swing-action handle
14 pin
a,b,c radii of eccentric element for different rotary positions
F arresting direction of rotation

The invention claimed is:

1. A pole grip, comprising:

a grip body, and a device for the adjustable fastening of a hand-retaining device in the form of a hand strap or of a glove, wherein for fastening on the pole grip, the hand-retaining device has, at least in a fastening region, a fastening element in the form of a flexible band, of a belt or of a woven-fabric strand, which, starting from the hand-retaining device, is initially guided through between an eccentric element, and an abutment, is then guided downward around the abutment and is subsequently guided out of a recess, a free end remaining and it being possible for the length at which the hand-retaining device is attached to the pole grip to be adjusted via said free end, and wherein, the eccentric element, at least in the fastening region is designed as an eccentrically mounted cylinder, that can be rotated or pivoted about an axial member, and in the fastening region, has a surface defined by a plurality of radii differing depending on a rotary position of the eccentric element, said radii, in relation to the axial member, increasing when rotating the eccentric element in an arresting direction of rotation at least in sections, continuously or in ribbed or stepped fashion, such that, by virtue of the eccentric element being rotated or pivoted in the arresting direction of rotation, the fastening element, which is guided, in the fastening region, between the surface of the eccentric element and the abutment, is clamped between the eccentric element and abutment.

2. The pole grip as claimed in claim 1, wherein the axial member of the eccentric element is arranged essentially perpendicularly to the pulling direction of the fastening element and essentially perpendicularly to the pole axis.

3. The pole grip as claimed in claim 1, wherein the eccentric element can be rotated or pivoted by a lever or a swing-action handle in order to clamp the hand-retaining device.

4. The pole grip as claimed in claim 3, wherein the grip body has no limit stop for the swing-action handle.

5. The pole grip as claimed in claim 1, wherein the swing-action handle, for the purpose of releasing the fastening of the hand-retaining device, is swung upward and, for the purpose of clamping the fastening of the hand-retaining device, is swung over forward or rearward in which case the lever is arranged essentially horizontally in the arresting position.

6. The pole grip as claimed in claim 5, wherein from the hand side, the grip body has, at the top end, a recess which, in the direction of the top side of the pole grip, has a through-opening in which the eccentric element is mounted by way of an axial pin guided in the grip body on both sides, and wherein the abutment is formed in the recess in the manner of a crosspiece or pin which is arranged beneath the eccentric element, is supported in the grip body on both sides and is arranged in particular preferably parallel to the axial member of the eccentric element.

7. The pole grip as claimed in claim 6, wherein the recess has a height in the range of 12-15 mm, and a width of 10-15 mm.

8. The pole grip as claimed in claim 1, wherein the lever or the swing-action handle is arranged on the top side of the pole grip, and in the arresting position is integrated at least partially, within the outer contour of the grip body.

9. The pole grip as claimed in claim 1, wherein the hand-retaining device is a strap with its top end fastened in a fixed or releasable fashion, in the manner of a safety-activation means, on the grip body, on the base of the recess, the strap being guided around the hand and having a region guided into the recess of the pole grip.

10. The pole grip as claimed in claim 1, wherein the swing-action handle, for the purpose of releasing the fastening of the hand-retaining device, is swung upward and, for the purpose of clamping the fastening of the hand-retaining device, is swung over rearward, and wherein the hand-retaining device is a strap with its top end fastened on the swing-action handle, the strap being guided around the hand and having a region guided into the recess of the pole grip.

11. The pole grip as claimed in claim 1, wherein the hand-retaining device is a glove or a strap-like device which can be fastened on the hand and, essentially between the thumb and forefinger, has a band which is guided into the recess of the pole grip.

12. A pole comprising a pole grip as claimed in claim 1, wherein he pole is a walking stick, a trekking pole, a downhill ski pole, a cross-country ski pole or a Nordic walking pole.

* * * * *